US005769533A

United States Patent [19]

Yamuro et al.

[11] Patent Number: 5,769,533

[45] Date of Patent: Jun. 23, 1998

[54] ILLUMINATION TAPE

[75] Inventors: Yukio Yamuro; Kenichi Tamate, both of Tokyo, Japan

[73] Assignee: Hiyoshi Electric Co., Ltd., Japan

[21] Appl. No.: 504,947

[22] Filed: Jul. 20, 1995

[30] Foreign Application Priority Data

Jul. 21, 1994 [JP] Japan ..... 6-169174

[51] Int. Cl.[6] ..... F21V 21/14

[52] U.S. Cl. ..... 362/249; 362/227; 362/252; 362/253; 362/800

[58] Field of Search ..... 362/249, 252, 362/253, 800, 227

[56] References Cited

U.S. PATENT DOCUMENTS 5,155,669 10/1992 Yamuro ..... 362/249

*Primary Examiner*—Ira S. Lazarus
*Assistant Examiner*—Matthew Spark
*Attorney, Agent, or Firm*—Elman & Associates

[57] ABSTRACT

A flexible illumination tape is provided with the emission from a number of luminous objects directed in a fixed direction. It comprises a long taping material of synthetic polyamide resin, etc., a plurality of luminous elements comprising luminous diodes, etc. mounted along the longer direction of the taping material, and an electric conductor of copper foil, etc. applied to both sides of the taping material. The plurality of luminous elements are mounted with the emission set in a fixed direction along the shorter direction of the taping material. Two input terminals span the taping material. The input terminals having the same polarity are soldered onto the same electric conductor so that they are connected in parallel. The illumination tape is flexible in making a sharp curve, refraction, etc.

8 Claims, 13 Drawing Sheets

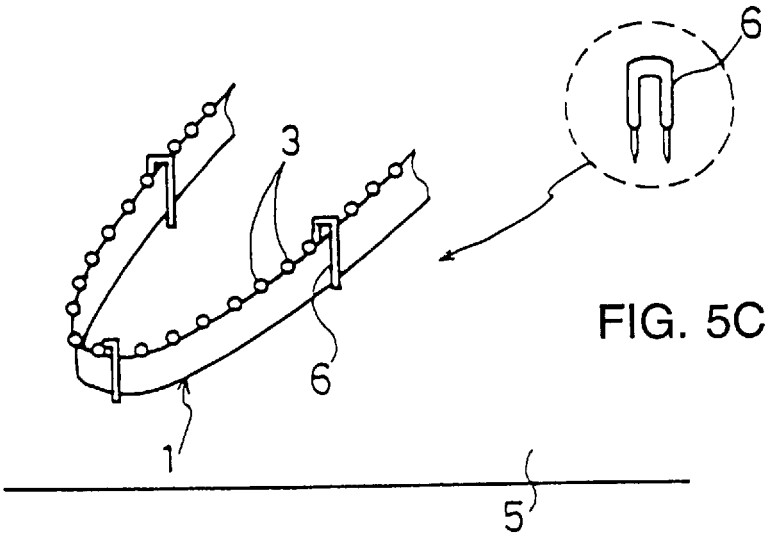
FIG. 5C
FIG. 5A
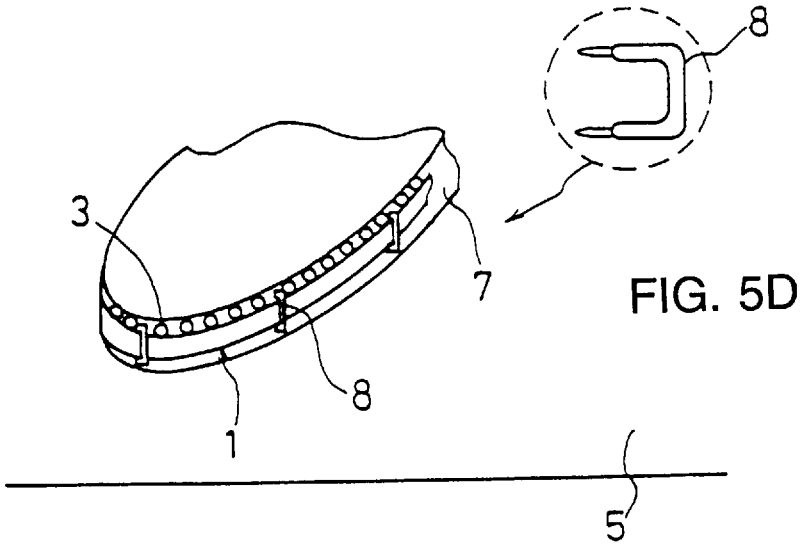
FIG. 5D
FIG. 5B

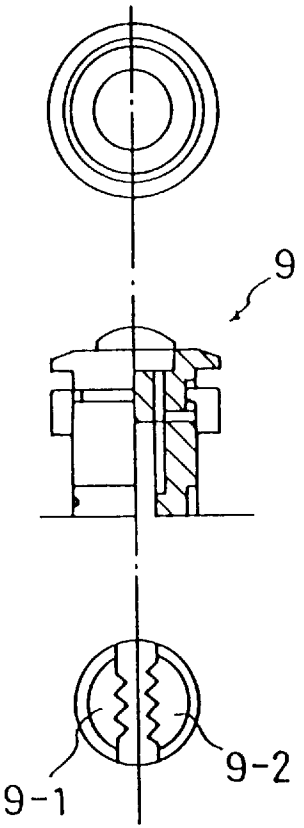
FIG. 12A
FIG. 12B
FIG. 12C
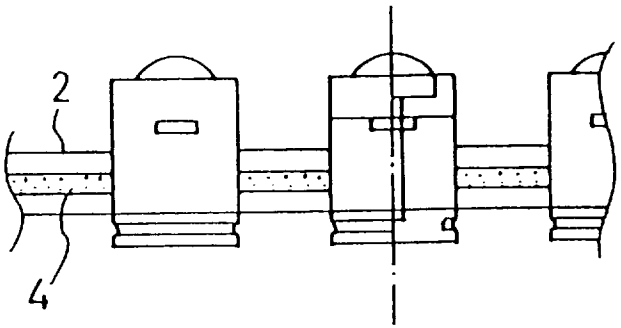
FIG. 12D

ILLUMINATION TAPE

BACKGROUND OF THE INVENTION

Description of the Prior Art

The illumination commonly referred to as "neon lamps" is in wide use all over the world. The neon lamps are designed with neon tubes formed in characters and various patterns, and are mounted onto sign boards at the entrances of stores, advertising towers on buildings, wing-type sign boards extended from the walls of buildings, etc, all designed to attract the attention of consumers at night.

The illumination using light sources connected in series at optional intervals, for example, a large number of small electric light bulbs mounted on long conductor wires, is also popular. However, with this type of illumination, the small electric bulbs face in different directions due to the natural twist and curve of the conductor wires. Normally, such an illumination method is often seen during the Christmas season.

The illumination using light sources, such as small electric light bulbs, facing in the same direction, has been put into commercial use with a number of light sources mounted vertically on the surface of a belt on which the light sources are arranged. The thus-arranged bulbs are practically used when they are connected to conductor wires running in the belt.

The above-described neon tubes are bent according to the various characters and patterns required for the sign board onto which the neon tubes are to be mounted. Since they are not of a fixed shape, such as the circular fluorescent tubes for use in the home, the bending process has not yet been automated and is performed manually. The bending angle can be optionally determined depending on the characters and patterns. Particularly, bending to a sharp angle corresponding to certain characters and patterns is accomplished with difficulty, and therefore requires advanced technology. Additionally, when mounting the thus-produced neon tubes onto the sign boards, they are fragile and they need to be handled with care. Practically, because labor costs have soared recently, it is almost impossible to properly train young engineers for such advanced technology. Under such circumstances, a smaller number of neon illuminations are being produced with the decreasing number of neon tubes and proficient engineers. Therefore, the work efficiency cannot be improved and the time required to complete neon illuminations has been extended.

Furthermore, the light from each of a large number of small electric light bulbs connected to long conductor wires is not emitted in a fixed direction, and the lights can be observed from all directions. Accordingly, they are suitable for use on the branches of trees and strung between different objects. However, they require a lot of labor to be used on sign boards indicating various characters and patterns, and therefore are not suitable for practical use because they require proper adjustment of the interval and direction of each of the small electric light bulbs.

If the small electric light bulbs are placed on a belt with their light emitted vertically to the surface of the belt, they can be easily mounted on an arch at the entrance of a mall, or to the flat surface of clothes. However, it is impossible to fold the belt across its width or even to bend it. Therefore, it is not suitable for use on advertising boards indicating various characters and patterns.

SUMMARY OF THE INVENTION

The present invention aims at providing a flexible illumination tape equipped with a large number of light sources with their emission fixed in a predetermined direction.

First, the illumination tape according to the present invention comprises a flexible tape material, having light sources placed along the length of the tape with their emission fixed to an outside of one side of the width, and electric conductors for connecting the plurality of light sources in parallel.

At least one electric conductor is mounted on each side of the tape material. It can also be designed such that at least two electric conductors are mounted on each side of the tape material. The electric conductor can comprise first, second, and third conductor elements. The first and second conductor elements enable the light sources to be connected in parallel. The first conductor element is connected to one electrode of the power source. The third conductor element is connected to the other electrode of the power source, and is also connected to the second conductor element through a plurality of resistors connected in parallel. A predetermined number of the light sources are arranged between each pair of the resistors.

The light sources can be light-emitting diodes, electric light bulbs, or discharge tubes.

The illumination tape can also comprise a flexible tape material, having light sources placed along the length of the tape with their emission fixed to an outside of one side of the width, and electric conductors for connecting the plurality of light sources in series.

With this configuration, the light sources can also be light-emitting diodes, electric bulbs, or discharge tubes.

As described above, the present invention discloses a flexible illumination tape which can be optionally bent, with a number of light sources emitting light in a fixed direction. Therefore, the required illumination can be created by freely bending the tape material according to the required characters and patterns. Thus, unlike the neon tubes, no advanced technology for preliminarily bending the material is required for the various characters and patterns, or no training for proficiency is required. As a result, the illumination can be completed at a lower cost and easily mounted on sign boards with a smaller probability of destruction even if it is not handled carefully. Accordingly, the illumination can be implemented more efficiently within a shorter construction period, thereby successfully pleasing the customers.

BRIEF DESCRIPTION OF THE DRAWINGS

FIGS. 5A 5B, 5C and 5D show examples of the methods of mounting the illumination tape onto the sign boards, etc.;

FIG. 12A, 12B and 12C shows the structure of the electrode of the light source according to the sixth embodiment;

FIG. 12D shows the illumination tape provided with the light elements; and

DESCRIPTION OF THE PREFERRED EMBODIMENTS

The embodiments of the present invention are described by referring to the attached drawings.

Figure 1A:
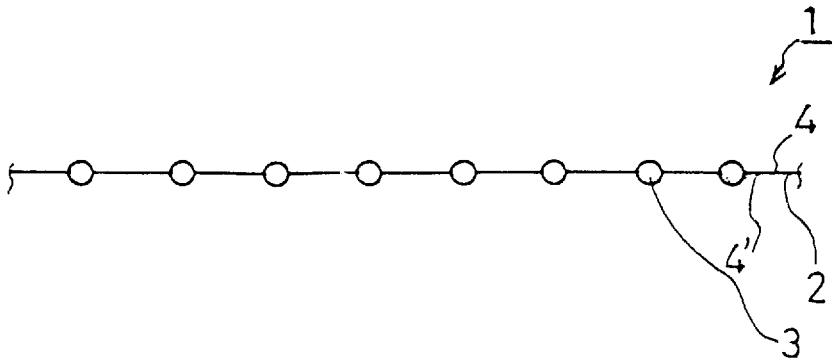
FIG. 1A is a top view of the illumination tape according to the first embodiment.
Figure 1B:
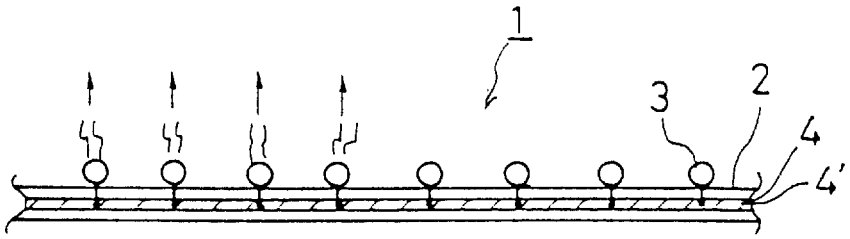
FIG. 1B is a side view of the illumination tape according to the first embodiment.
Figure 1C:
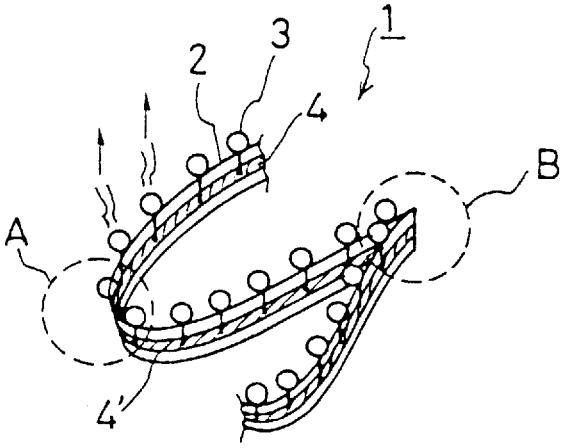
FIG. 1C is an oblique view of the state of the illumination tape.

FIG. 1A is a top view of an illumination tape according to the first embodiment; FIG. 1B is a side view of the illumination tape; and FIG. 1C is an oblique view of the state of the illumination tape. As shown in these figures, an illumination tape 1 comprises a long tape material 2 made of synthetic resin, etc., a plurality of light elements 3 placed along the length of the tape material 2, and copper foils 4 and 4' each applied to either side of the tape material 2.

The tape material 2 is made of, for example, polyamide-type synthetic resin, etc. If it is flexible enough, it can be freely used as is. Even if it is less flexible, it also can be flexibly used by preliminarily making a series of folds. The oblique view in FIG. 1C shows the flexible state and indicates a sharp curve like a hair-pin as shown in a circle A, and a sharp fold in a circle B.

The plurality of light elements 3 are placed with each light emitting surface (primary light emitting direction, hereinafter simply referred to as an emitting direction) facing in a fixed direction (upwards in the examples shown in FIGS. 1B and 1C) along the width of the tape material 2. These light elements 3 are arranged as straddling the tape material 2, and having two input terminal lead lengths. They are connected in parallel by soldering the input terminal leads having the same polarity to the corresponding one of copper foils 4 and 4'.

The copper foils 4 and 4' are embedded within the tape material 2 and thereby being insulated from any external units. The tape material 2 is stripped off from the copper foils 4 and 4' only at the connection points with the light elements 3. The copper foils 4 and 4' are provided with terminal leads connected to the power source at the end of the illumination tape 1, and which may be extended externally.

The copper foils 4 and 4' do not have to be embedded, but can be formed by etching on the surface of the tape material 2. The conductors are not limited to the copper foils 4 and 4', but can be conductor wires or any material in any form if they are electrically-conductive and flexible.

Figure 2:
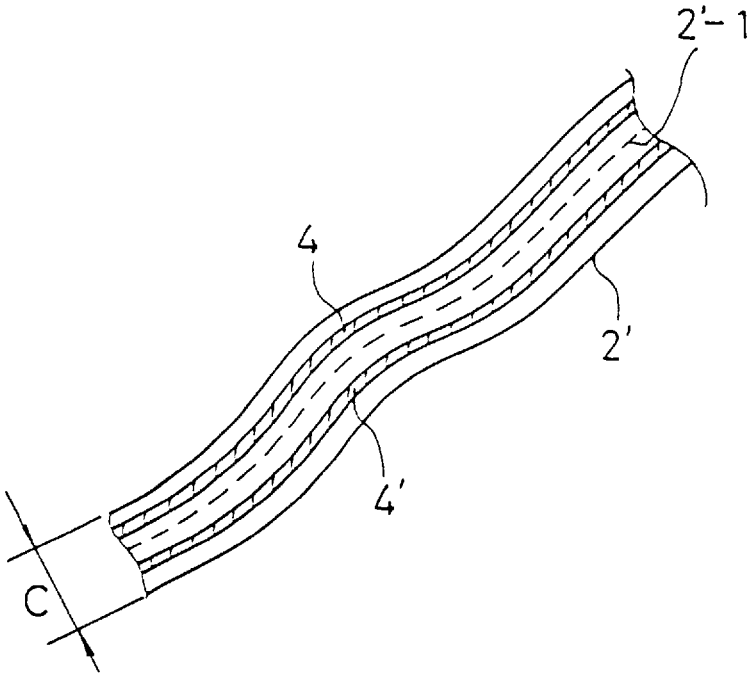
FIG. 2 shows an example of the copper foil formed by etching on the surface of the tape material.

FIG. 2 shows an example of the copper foils 4 and 4' formed by the above described etching process. The width C of the tape material 2' shown in FIG. 2 is double the width of the completed illumination tape. The broken line 2'-1 shown in FIG. 2 indicates the center line. As shown in FIG. 2, after forming the copper foils 4 and 4' on the tape material 2' on either side of the center line 2'-1, the tape is then folded down the center line 2'-1 to obtain tape material similar to the illumination tape 1 shown in FIG. 1.

In any case, the tape material 2 is immersed in an ultra-violet-ray curing (UV) resist material in a subsequent process, and the resist film is exposed to ultra-violet light for curing so that a soft insulation film can be formed over the tape material 2, the input terminal lead lengths of the light source 3, and the copper foils 4 and 4' (or substitute electrical conductors). The UV resist can be substituted with an illumination tape 1 inserted into a transparent heat-shrinkable tube, thereby being insulated from external units.

Figure 3A:
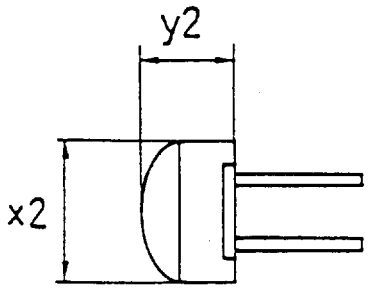
FIGS. 3A 3B, 3C and 3D show examples of the form and size of the light-emitting diode used as a light source.
Figure 3B:
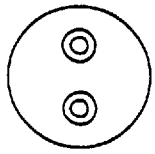
Figure 3C:
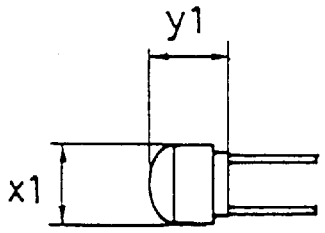
Figure 3D:
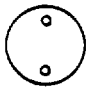

FIGS. 3A 3B, 3C and 3D show two examples of the form and size of the light source 3 comprising a light-emitting diode. FIGS. 3A, and 3B show an example of a relatively small light source provided with a light-emitting diode on its light-emitting surface. The light source has a diameter x1 and height y1. An appropriate illumination tape on which the light elements are arranged is some tens of microns in thickness and several millimeters in width. However, it is obvious that size is not limited, but is variable depending on each demand.

The light source shown in FIG. 3B is provided with a plurality of light-emitting diodes on its light-emitting surface.

Figure 4C:
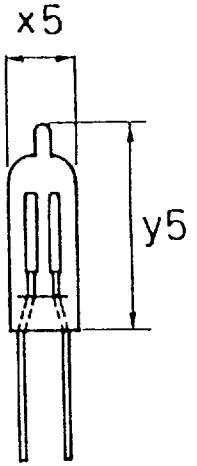
FIGS. 4A, 4B, and 4C show examples of the form and size of electric light bulbs used as a light source.
Figure 4B:
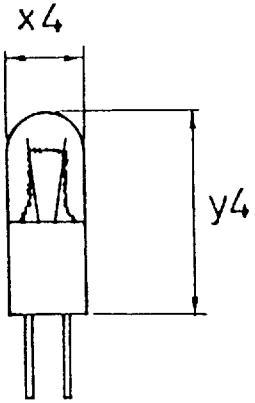
Figure 4A:
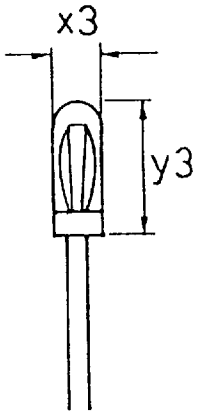

FIGS. 4A and 4B show examples of the form and size of the light sources 3 comprising electric bulbs. The electric bulbs shown may be of various sizes.

FIGS. 4A and 4B show examples of incandescent filament lamps, and FIG. 4C shows an example of the form and size of the light source 3 comprising a discharge tube (neon lamp).

FIGS. 5A 5B, 5C and 5D show examples of methods for mounting the above configured illumination tape 1 on a sign board, etc. In FIGS. 5A 5B, 5C and 5D the illumination tape 1 is shown with only the light sources 3 and the tape material, and the input terminal lead lengths of the light sources 3 and the copper foils 4 and 4' for connecting them to the power source are omitted here for clarity.

FIGS. 5A, and 5C shows an example of a case where the illumination tape 1 is directly attached to a sign board 5. As shown in FIG. 5A, the illumination tape 1 is fastened with narrow U-shaped fittings 6 (shown in FIG. 5C) from above, and both ends of the fittings 6 are fastened to the sign board 5 along the forms of the characters and graphics (not shown in the figures) drawn on the sign board 5. Thus, the illumination tape 1 can be freely formed and easily mounted onto the sign board 5.

FIGS. 5B, and 5D show an example of the case where the illumination tape 1 is mounted onto the 3-dimensional object 7 of characters and graphics on the sign board 5. In this case, the illumination tape 1 is fastened from its side with wide U-shaped fittings 8 (shown in FIG. 5D) as shown in FIG. 5B. The illumination tape 1 can be easily mounted exactly along the contour of the 3-dimensional characters or graphics by applying the fittings 8 to the side of the 3-dimensional object 7.

Obviously, the fittings are not limited to the U-shaped fittings shown. That is, any fittings or fitting methods can be adopted as long as the illumination tape 1 can be successfully mounted onto the sign board 5 or the 3-dimensional object 7. For example, when the illumination tape 1 is mounted on the 3-dimensional object 7, it can be attached simply by nails. However, in this case, care must be taken to provide holes through which the nails are applied so that the nails penetrate the illumination tape 1 without touching the copper foils 4 and 4'. Thus, the illumination tape 1 can be mounted quite easily.

Figure 6A:
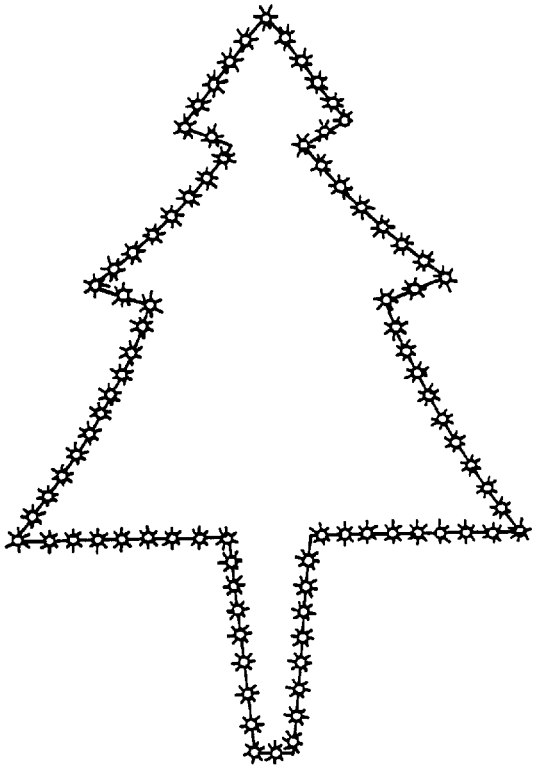
FIGS. 6A and 6B show examples of the completed illuminations.
Figure 6B:
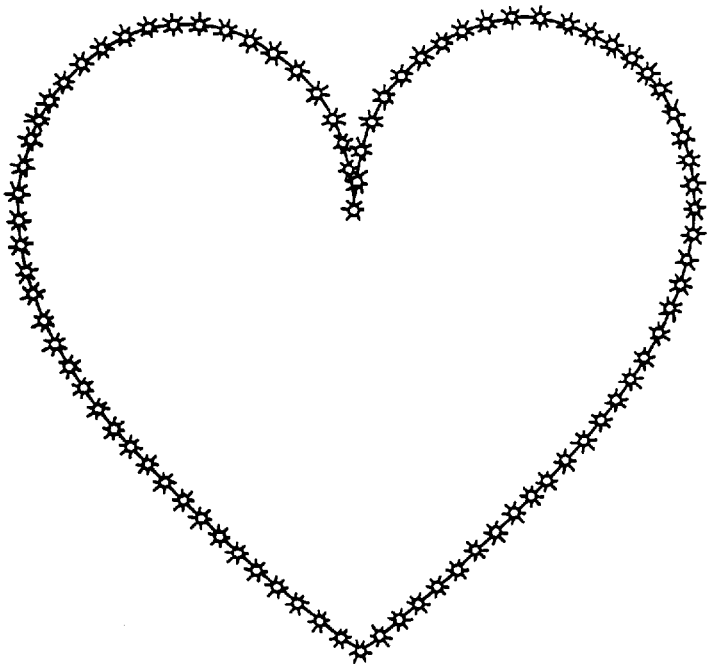
Figure 7A:
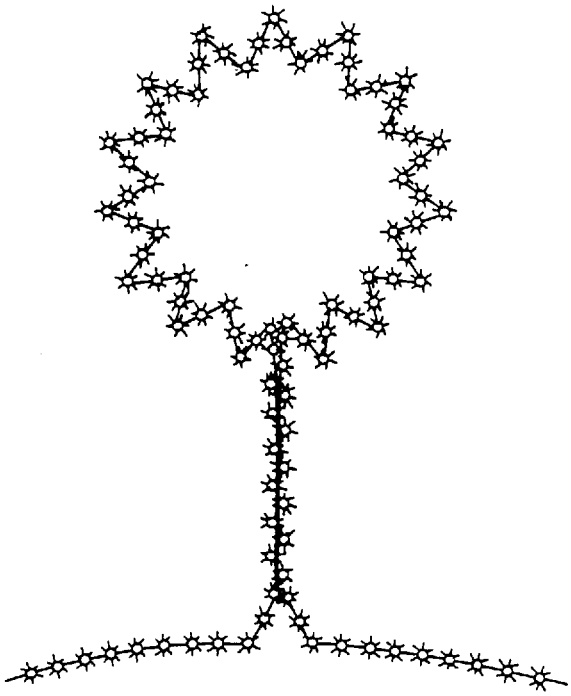
FIGS. 7A and 7B show other examples of the completed illuminations.
Figure 7B:
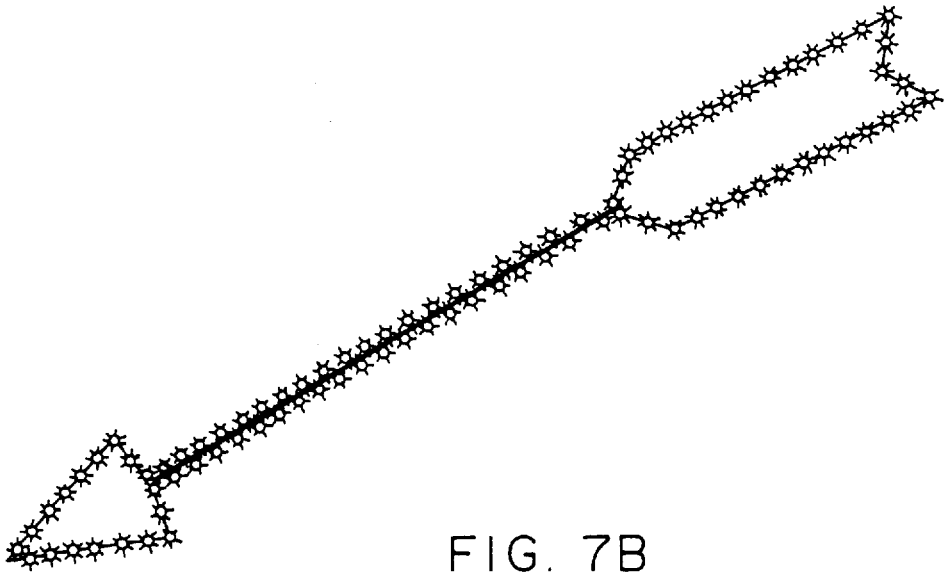

FIGS. 6A, 6B, 7A, and 7B show four examples of the illumination tape mounted on a sign board. FIG. 6A shows an example in the form of a tree. FIG. 6B shows an example in the form of a heart. FIG. 7A shows an example in the form of a flower. FIG. 7B shows an example in the form of an arrow. As shown in these figures, the illumination tape 1 can form graphics and characters by easily following the contour of any shape or angle.

Figure 8A:
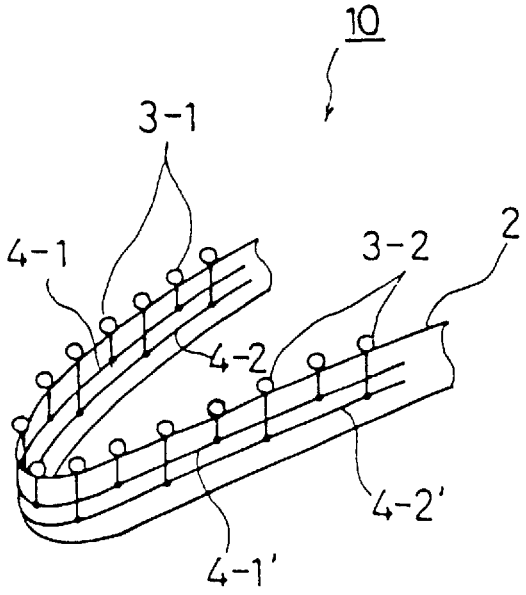
FIG. 8A shows an illumination tape according to the second embodiment.
Figure 8B:
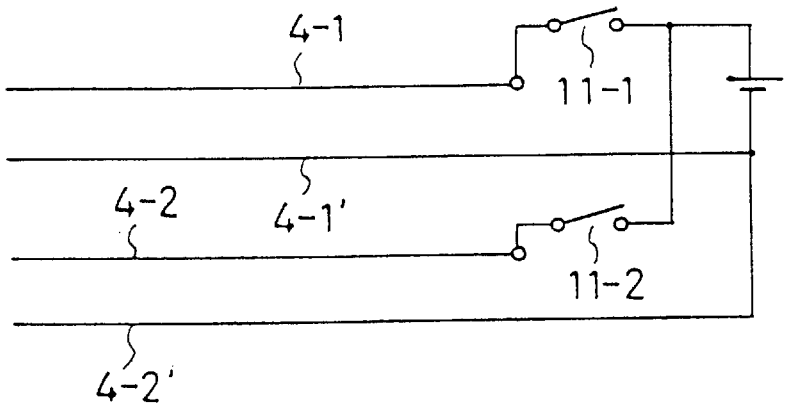
FIG. 8B shows an example of the wiring connections of the tape.

FIG. 8A shows the illumination tape according to the second embodiment of the present invention. FIG. 8B shows an example of the wiring connections for the illumination tape. As shown in FIG. 8A, an illumination tape 10 has the arrangement of a plurality of light sources 3 placed along the length of the tape material 2 with a shorter input terminal lead lengths 3-1 and a longer input terminal lead lengths 3-2 arranged alternately. One surface of the tape material 2 is provided with the copper foils 4-1 and 4-2, and the other surface of the tape material 2 is provided with the copper foils 4-1' and 4-2'. The light sources 3-1 having shorter input terminal lead lengths are connected in parallel by the copper foils 4-1 and 4-1', and the light sources 3-2 having longer input terminal lead lengths are connected in parallel by the copper foils 4-2 and 4-2'. The illumination tape 10 is different from the illumination tape 1 shown in FIG. 1 only in configuration, however, it comprises the same components. If the power source connection terminals of the copper foils 4-1 and 4-1' are connected to a switch 11-1, and the power source connection terminals of the copper foils 4-2 and 4-2' are connected to a switch 11-2 at the end of the illumination tape 10, as shown in FIG. 8B, the illumination tape 10 can be controlled by the switches 11-1 and 11-2 to have the light source 3-1 having shorter input terminal lead lengths and the light source 3-2 having longer input terminal lead lengths to be turned on alternately or simultaneously, etc.

The light source 3-1 having shorter input terminal lead lengths and the light source 3-2 having longer input terminal lead lengths are not always arranged alternately, but can be arranged optionally, for example, alternately in units of two, units of ten, etc.

Figure 9A:
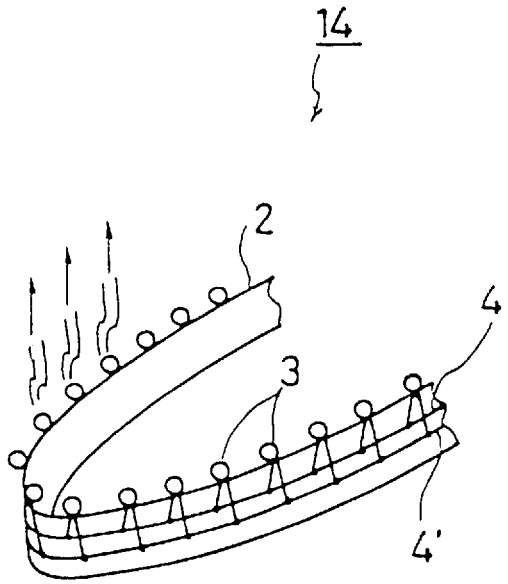
FIG. 9A shows an illumination tape according to the third embodiment.
Figure 9B:
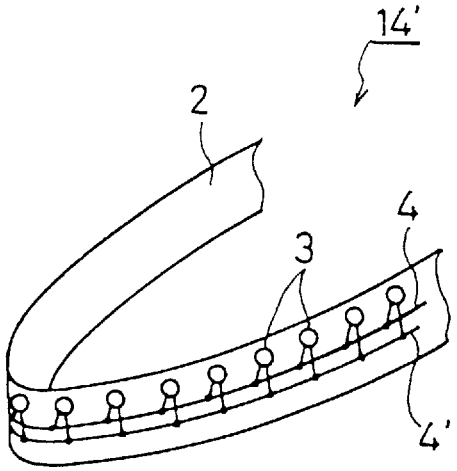
FIG. 9B shows a variation of the illumination tape.

FIG. 9A shows the illumination tape according to the third embodiment of the present invention. FIG. 9B shows a variation of the illumination tape. First, the illumination tape shown in FIG. 9A has the copper foils 4 and 4' placed on only one side of the tape material 2. A plurality of the light sources 3 have input terminal leads of different lengths and have the same polarity between the long input terminal lead lengths or between short input terminal lead lengths. Unlike the illumination tapes 1 or 10, these light sources 3 do not straddle the tape material 2 with their two input terminal lead lengths. However, as shown in FIGS. 1 and 8, the light-emitting portions are fixed on the side of the tape material 2 (mounted vertically along the width of the tape material 2 in the figures), and the light sources are placed with their light-emitting surface facing a fixed upward (the head portion extended) direction. The shorter input terminal lead lengths are connected to the copper foil 4 and the longer input terminal lead lengths are connected to the copper foil 4', each being connected in parallel. In this case, the illumination tape is different only in configuration from the illumination tapes shown in FIGS. 1 and 8, but they use the same components. The tape material 2 used for an illumination tape 14 can save the step of folding the tape material down the center line in a subsequent process even if the copper foils 4 and 4' are formed by etching.

With such configuration, the light-emitting portions can be arranged at the same height as the edge of the tape material 2, or a little below the edge of the tape material 2, not extending over the edge of the tape material 2, as shown in FIG. 9B. With this configuration of the illumination tape 14', the light-emitting portion of the light source 3 is arranged on the opposite side to the fixture side of the tape material 2, when the illumination tape is mounted onto the 3-dimensional material 7 as shown in FIG. 5B. Therefore, the 3-dimensional material 7 is not damaged by being pushed to the light source 3.

Figure 10:
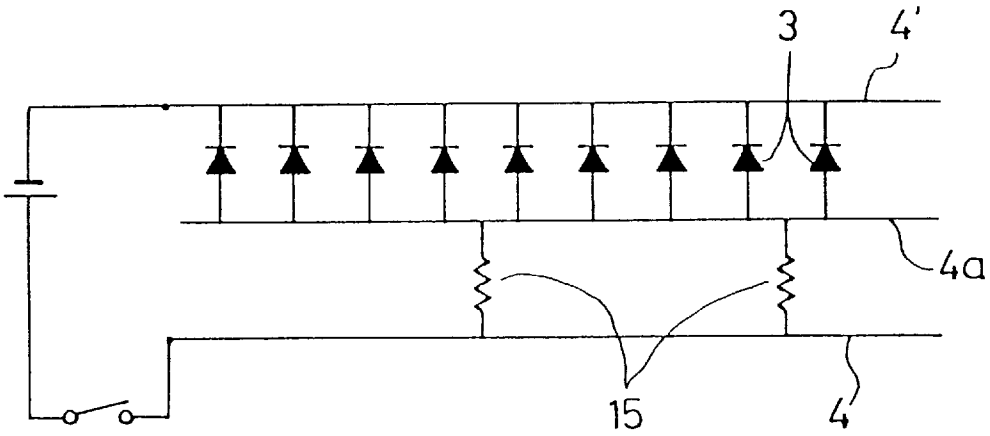
FIG. 10 shows the wiring connections of the illumination tape according to the fourth embodiment.

FIG. 10 shows the wiring connections for the illumination tape according to the fourth embodiment of the present invention. As shown in FIG. 10, the electric conductors comprise the first, second, and third conductor elements (copper foils 4, 4*a*, and 4' in this example). The copper foil 4' is the first conductor element and is connected to one electrode (the negative electrode in the example shown in FIG. 10) of the power source. The copper foil 4 is the third conductor element and is connected to the other electrode (the positive electrode in the example shown in FIG. 10) of the power source. The light sources 3 are connected in parallel by the copper foil 4', (the first conductor element), and the copper foil 4*a*, (the second conductor element). The copper foil 4*a* is the second conductor element and is connected to the copper foil 4 which is the third conductor element through a plurality of resistors 15 arranged in parallel between the second and the third conductor elements. The light sources 3 are arranged between the resistors 15 in units of a predetermined number (four units in the example shown in FIG. 10) of light sources.

This configuration is very effective when no resistors are built into the light source 3 or when the allowable voltage does not match the voltage of the power source even if resistors are built into the light source 3. The resistors 15 set the resistance value such that a voltage of 2 V is provided between the copper foils 4' and 4*a* if the light sources 3 are for operation at 2 V (volt). With this configuration, the illumination tape 1 can be cut into optional lengths of the tape material depending on use, with the predetermined 4 units of the light sources 3 contained in the cut length because at least one voltage-adjusting resistor 15 is contained between the copper foils 4 and 4*a*.

In the example, a 4-unit set of light sources 3 are assigned between the resistors 15. The present invention is not limited to this number, and the number of the light sources 3 in a set can be optionally determined. However, if a smaller number of the light sources 3 is determined for a set, the total number of resistors becomes large. By contrast, if a larger number of the light sources 3 is determined for a set, then the minimum length of each cut piece of the tape material becomes longer. Accordingly, the number of the light sources 3 in a set can be determined depending on each of the various uses. The resistor can be thus arranged when the light source is a light-emitting diode or discharge tube. No resistors are required when electric light bulbs are used as light sources.

Figure 11:
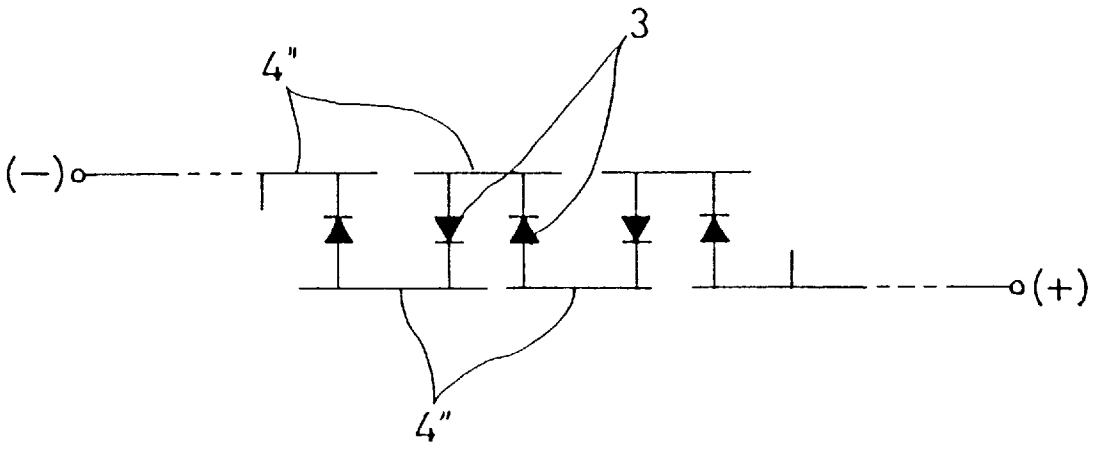
FIG. 11 shows the wiring connections of the illumination tape according to the fifth embodiment.

FIG. 11 shows the wiring for the illumination tape according to the fifth embodiment of the present invention. As shown in FIG. 11, a number of short conductor elements of copper foils 4" are mounted in two rows along the length of the tape material 2 (not shown in FIG. 11). The rows of the copper foils 4" are spaced by a predetermined interval, each row being positioned opposite to the other along the length. The light sources 3 are connected in series via the copper foils 4". When the length of the illumination tape is predetermined, the resistor value or number of the required resistors can be reduced to the minimum possible value, if the appropriate number of the light sources 3 of an appropriate allowable voltage can be arranged depending on the voltage of the power source as shown in FIG. 11.

The illumination tape according to the sixth embodiment of the present invention will be described by referring to FIGS. 12A, 12B, 12C and 12D. FIGS. 12A, 12B and 12C show the structure of the electrode of the light source used for the illumination tape. FIG. 12D shows the illumination tape provided with the light sources. Two input terminals 9-1 and 9-2 of a light source 9 are made of an electric conductor which is both rigid and plastic. Unlike the input terminal lead lengths of the light sources according to other embodiments, they are not formed of a lead electrode, but formed as a cylinder which is vertically divided into two portions. As shown in FIG. 12C, the surface is formed in a zigzag shape. As shown in FIG. 12D, the tape material 2 is inserted in the width between the input terminals 9-1 and 9-2. That is, the input terminals 9-1 and 9-2 hold the tape material 2, and the light sources 9 are slid in the length of the tape material 2 to be arranged at the desired positions. When the light sources 9 are clamped by, for example, a pinching process (they can be automatically clamped by a continuous process, etc.), the zigzag portions properly locate onto the tape material 2 and copper foils 4 and 4' (copper foil 4' cannot be viewed because it is on the reverse side). The input terminals 9-1 and 9-2 are deformed due to their plasticity, and the light sources 9 are connected to the copper foils 4 and 4' and firmly fixed to the tape material 2. Since the light sources 9 are deformed due to their plasticity, they can be freely replaced or exchanged later.

The light sources 3 (or 3-1, 3-2, or 9) are arranged with their light-emitting surfaces facing in a fixed direction along the width of the tape material. However, the present invention is not limited to this application.

Figure 13:
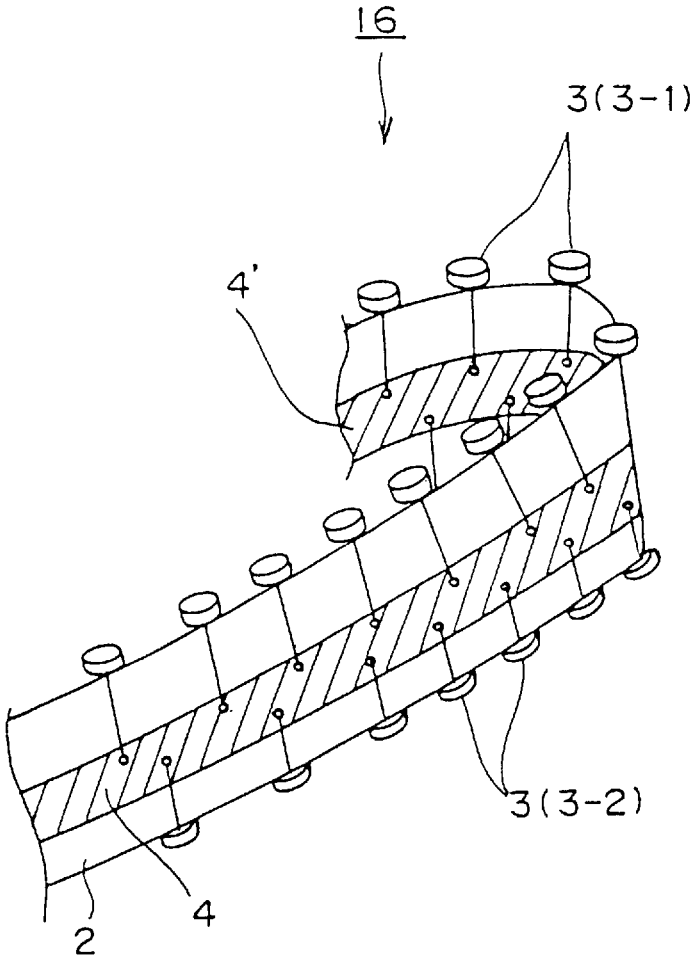
FIG. 13 shows an illumination tape according to the seventh embodiment.

FIG. 13 is an oblique view of the seventh embodiment in which the light sources are arranged with their light-emitting surfaces facing in both directions along the width of the tape material. The illumination tape 16 shown in FIG. 13 is the same as the illumination tape 1 shown in FIGS. 1A through 1C in the use of components such as the tape material 2, light source 3, copper foils 4 and 4'. However, the direction of the light sources 3 is different between the illumination tape 16 and the illumination tape 1. For example, as shown in FIG. 13, a set 3(3-1) containing a predetermined number of the light sources 3-1 is arranged with the light-emitting surfaces facing in a fixed direction along the width of the tape material 2. The other set 3(3-2) containing the same number of the light sources 3-2 is arranged with the light-emitting surfaces facing in the other direction along the width of the tape material 2. In FIG. 13, the light sources 3-1 and 3-2 are alternately arranged. They can also be arranged in-line with their electrodes opposite to each other. The illumination tape 16 according to the present embodiment can be very effective as an outstanding illuminated sign seen from either direction of a road when the illumination tape is used on the outline of characters on a signboard, etc. mounted on a building, etc.

What is claimed is:

1. An illumination tape comprising:

a flexible tape material having a first face and a second face, a first edge and a second edge and a first end and a second end, said faces being of substantially equal length and being opposite sides of a thickness of said flexible tape material, each of said faces having a width substantially greater than said thickness of said flexible tape material and each of said edges having a length substantially greater than said width;

a plurality of light sources placed along a length of said first edge of said flexible tape material with light-emitting surfaces of said light sources substantially aligned and facing outwardly perpendicular from said first edge of said flexible tape material; and a plurality of electric conductors attached to said first face along the length of said flexible tape material for connecting said plurality of light sources electrically in parallel.

2. The illumination tape according to claim 1, wherein:

at least one electric conductor is mounted on said first face and at least one electric conductor is mounted on said second face of said flexible tape material.

3. The illumination tape according to claim 1, wherein:

at least two electric conductors are mounted on said first face of said flexible tape material.

4. The illumination tape according to claim 1, wherein:

said electric conductors comprise first, second, and third conductor elements;

said light sources are electrically connected in parallel between said first conductor element and said second conductor element;

said first conductor element is adapted to be connected to a first electrode of a power source having said first electrode and a second electrode:

said third conductor element is adapted to be connected to said second electrode of the power source, and said third conductor element is connected to said second conductor element through a plurality of voltage-adjusting resistors electrically connected in parallel with one another, wherein each of said resistors is positioned such that plurality of said light sources are located between each pair of said resistors.

5. The illumination tape according to claim 1, wherein:

said light sources are light-emitting diodes.

6. The illumination tape according to claim 1, wherein:

said light sources are electric light bulbs.

7. The illumination tape according to claim 1, wherein:

said light sources are discharge tubes.

8. An illumination tape comprising:

a flexible tape material having a first face and a second face, a first edge and a second edge and a first end and a second end, said faces being of substantially equal length and being opposite sides of a thickness of said flexible tape material, each of said faces having a width substantially greater than said thickness of said flexible tape material and each of said edges having a length substantially greater than said width;

a plurality of light sources placed along a length of said first edge of said flexible tape material with light-emitting surfaces of said light sources substantially aligned and facing outwardly perpendicular from said first edge of said flexible tape material; and a plurality of electric conductors attached to said first face alone the length of said flexible tape material for connecting said plurality of light sources in series.

* * * * *